US005626089A

United States Patent [19]

Schneider et al.

[11] Patent Number: 5,626,089

[45] Date of Patent: May 6, 1997

[54] GRATE PLATE FOR PUSHER GRATE COOLERS FOR THE COOLING OF HOT MATERIAL

[75] Inventors: Richard Schneider, Wermelskirchen; Hans-Jürgen Stahl, Köln, both of Germany

[73] Assignee: Klöckner-Humboldt-Duetz AG, Cologne, Germany

[21] Appl. No.: 587,888

[22] Filed: Jan. 16, 1996

[30] Foreign Application Priority Data

Feb. 11, 1995 [DE] Germany ..... 195 04 588.2

[51] Int. Cl.[6] ..... F23H 11/08

[52] U.S. Cl. ..... 110/281; 110/291; 432/77; 432/78

[58] Field of Search ..... 110/257, 259, 110/263, 267, 268, 269, 278, 280, 281, 288, 290, 291, 306, 328, 329; 432/77, 78, 58, 239

[56] References Cited

U.S. PATENT DOCUMENTS

| | | | |
|---|---|---|---|
| 4,078,883 | 3/1978 | Arnold | 432/239 |
| 4,200,047 | 4/1980 | Knorr | 110/268 |
| 4,201,545 | 5/1980 | Riechert | 432/239 |
| 4,600,098 | 7/1986 | Orren | 110/278 |
| 5,174,747 | 12/1992 | Massaro, Jr. et al. | 110/268 |
| 5,322,434 | 6/1994 | Milewski et al. | 110/306 |
| 5,433,157 | 7/1995 | Dittmann et al. | 110/281 |
| 5,497,711 | 3/1996 | Bobbitt et al. | 110/278 |

FOREIGN PATENT DOCUMENTS

4205534A1 8/1993 Germany .

*Primary Examiner*—Henry A. Bennett
*Assistant Examiner*—Gregory A. Wilson
*Attorney, Agent, or Firm*—Hardaway Law Firm P.A.; Charles L. Schwab

[57] ABSTRACT

The service life of grate plates for pusher grate coolers for the cooling of hot cement clinker, and the like, is greatly increased at low cost by providing a replaceable wearing part (21) at the forward plate end pushing edge of the grate plate body (12). The wear life of the overlap region of the surface of the grate plate is enhanced by special treatment or coating.

9 Claims, 1 Drawing Sheet

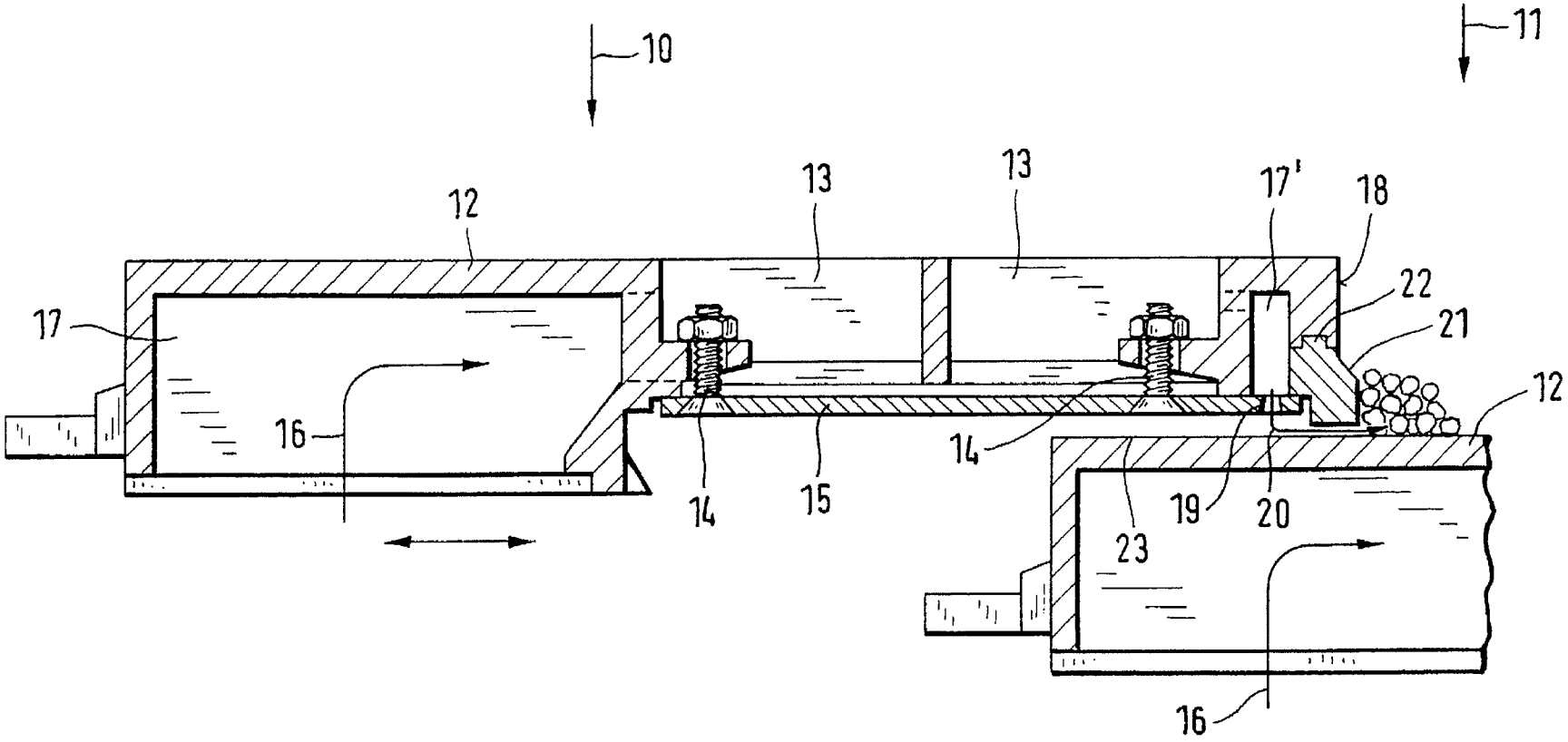
11
10
12
13
13
14
14
15
16
16
17
17'
18
19
20
21
22
23

GRATE PLATE FOR PUSHER GRATE COOLERS FOR THE COOLING OF HOT MATERIAL

TECHNICAL FIELD

This invention relates to a grate plate for pusher grate coolers used to cool hot material, such as hot cement clinker, which have upwardly open material-receiving pans arranged on the top side of the body. Cooling air ducts in the grate plate body are arranged parallel to the longitudinal axis of the grate plate, and cooling air is supplied to the pans by way of lateral cooling air discharge slots. The grate plates are alternately fastened to stationary and movable grate plate supports, through which the cooling air flows to the grate plates.

BACKGROUND OF THE INVENTION

In a pusher grate cooler, the grate system consists of a plurality of stationary and movable grate plate supports, on each of which there are fastened several grate plates provided with cooling air openings and through which cooling air flows substantially upward. As viewed in the conveying direction, stationary ranks of grate plates alternate with ranks of movable grate plates fastened to back and forth movable grate plate supports, which in turn may be mounted on one or a plurality of power oscillated pusher frames. The oscillating motion of the movable ranks of grate plates causes the hot material to be transported as it is cooled. Pusher grate coolers are particularly useful in conveying and discharging cement clinker from a rotary kiln. In the grate plate described in German patent document DE 42 05 534, pans are formed in the top side of the grate plate body. The pans serve to receive and hold in place material being cooled and shield the grate from the hot material. Thus, the grate plate is protected and its service live is prolonged. A base plate is bolted to the bottom of a grate plate body to form a bottom wall for cooling air ducts and to form the bottom of the pans, thus preventing the material being cooled from falling through the grate plate. The overlap region of the grate plate is subject to mechanical and thermal stresses during operation of the pusher grate cooler and the plate end pushing edge is especially subject to thermal stress and wear. If the plate end pushing edge of this prior art grate plate becomes worn, it is necessary to replace the entire grate plate body.

OBJECTS AND SUMMARY OF THE INVENTION

It is an object of the invention to create, for a pusher grate cooler, a grate plate which has a long, economical service life.

It is a further object of this invention to provide a grate plate which is economically renewable in case of wear.

In the grate plate for a pusher grate cooler of this invention, the leading plate end pushing edge, as viewed in the grate pushing direction, is no longer integral with the grate plate body. Instead, the plate end pushing edge consists of a separate component, or wearing part, which is detachably fastened to the grate plate body so that it can be replaced when it becomes worn. By this invention, an important wear portion of the grate plate has been made replaceable. The replaceable plate end pushing edge can be held in its installed position by a base plate, which in turn may be detachably held against the bottom of the grate plate body, by a bolted connection. In such case the grate plate in accordance with the invention would be in three parts, consisting of a grate plate body, a replaceable plate end pushing edge, and a base plate. The grate plate may be made in two parts, by making the plate end pushing edge in one piece with the base plate; in which case the base plate and the plate end pushing edge are integral and replaceable as a unit.

The owner of a pusher grate cooler equipped with the grate plates of this invention experiences the advantage of very economical spare parts management because of the low-cost replacement of the plate end pushing edges in event of their becoming worn.

The grate plate body is made of cast steel; however, the replaceable plate end pushing edge is preferably made of a more wear-resistant material, such as high-chromium and/or high-carbon steel.

The upward facing surface of the grate plate body is made more wear-resistant in the rearward region (overlap region), of the plate, as viewed in the grate pushing direction, than in the remaining region of the grate plate. This overlap region cooperates with the back and forth oscillating plate end pushing edge of the adjacent grate plate. This wear-resistant surface region of the grate plate body may be treated by means of an Alonizing treatment, that is, by means of a heat treatment of the surface in which aluminum oxides such as $Al_2O_3$ diffuse into the surface, which produces a desirable alteration of the surface structure. The wear-resistant surface region of the grate plate body may also be treated by partial coating. Partial coating may be achieved by placing tungsten carbides in the casting mold for the grate plate body. The tungsten carbides are held in place by the casting melt because of melting point differences of the two metallic materials.

BRIEF DESCRIPTION OF THE DRAWING

One embodiment of the invention is shown in the drawing which is a vertical longitudinal section through two grate plates of a pusher grate cooler.

DETAILED DESCRIPTION OF THE DRAWING

As illustrated in the drawing, a movable grate plate (10) and a stationary grate plate (11) are arranged one behind the other as viewed in the grate pushing direction of a pusher grate cooler. Each of the grate plates has a grate plate body (12) made of cast steel. The left-hand grate plate body (12) is fastened to a back and forth movable, individually aerated grate plate support in the form of a hollow beam, while the right-hand grate plate body (12) is fastened to a stationary grate plate support in the form of a hollow beam. Each grate plate top side has four upwardly open pans (13) serving to receive and hold in place the hot material being cooled, two pans (13) lying one next to another on each of the laterally opposite sides of the longitudinal axis of the grate plate, so that there are four pans (13) in each grate plate. The material to be cooled is gradually transported from left to right, and simultaneously cooled, by the oscillating motion of the movable grates (10).

A base plate (15) is bolted to the grate plate body (12) from underneath, by bolts (14). The base plate (15) forms a bottom wall for each of the pans (13) and a bottom wall for cooling air ducts, which are formed parallel to the grate plate longitudinal axis and alongside and between the pans (13). The laterally inward positioned duct side walls do not extend all the way downwardly to the base plate (15), thus providing lateral discharge slots for supply cooling air to the pans (13).

The cooling air (16), flowing out of the individually aerated grate plate supports in the form of hollow beams, passes into the air chamber (17) of each grate plate and from there into the cooling air ducts arranged parallel to the grate plate longitudinal axis and between and alongside the pans (13) for material being cooled. Cooling air passes through lateral discharge slots into the pans (13) and also passes to a forward cooling duct (17'). The forward cooling duct (17') lies transversely to the plate longitudinal axis and serves to cool the forward plate end surface (18), which is particularly subject to mechanical and thermal stresses. The partial stream of cooling air diverted from the full stream flowing through the grate plate leaves the forward cooling duct (17') by way of small discharge openings (19) in the base plate (15). This partial stream of cooling air, designated by (20), may be a fraction of approximately 5 to 10% of the total air flow through the grate plates and it simultaneously serves as seal air in the overlap slot between the individual ranks of grate plates of the pusher grate cooler.

The forward plate end pushing edge as viewed in the grate pushing direction includes a replaceable plate end pushing edge in the form of a replaceable wearing part (21), which is made of wear-resistant material and is detachably attached to the grate plate body (12). In case the pushing edge becomes worn, only this replaceable component (21) needs to be replaced. In the exemplary embodiment illustrated in the drawing, this replaceable plate end pushing edge (21) is held in its illustrated installed position by the base plate (15), which in turn is detachably fastened to the bottom of the grate plate body (12) by releasable fastening means in the form of bolts (14) and nuts. For better securing of the replaceable plate end pushing edge (21) on the forward wall (18) of the grate plate body (12) and to accept the plate pushing forces, these two components may have abutment and keyed surfaces such as provided by the illustrated tongue-and-groove connection (22). Dovetail connections, or the like, can also be used. These two components may also be bolted together or otherwise detachably connected.

The surface of the grate plate body (12) is made more wear-resistant in the rearward plate region or overlap region (23) as viewed in the grate pushing direction. This region is swept by the replaceable plate end pushing edge (21) of the adjacent grate plate. This wear-resistant surface region (23) of the grate plate body (12) may be treated by an Alonizing treatment or by a partial coating, as has hereinbefore been described.

The owner of a pusher grate cooler equipped with the grate plates of this invention has the advantage of economical spare parts management and the simultaneous assurance of long-term serviceability and usage of the grate plates. The result is a lower cost in cement production.

What is claimed is:

1. A grate plate for a pusher grate cooler for the cooling of hot cement clinker of the type having a plurality of grate plates through which cooling air flows, said grate plates being fastened to grate plate supports alternately stationary and movable back and forth in the grate conveying direction, said grate plate comprising:

a grate plate body (12) having upwardly open material-receiving pans (13), a base plate (15) forming a bottom wall for said material-receiving pans (13) releasably secured to the bottom of said grate plate body (12), cooling air ducts formed by said grate plate body (12) and said base plate (15), said cooling air ducts extending parallel to the longitudinal axis of said grate plate and having lateral air discharge slots for supplying cooling air to said pans and, a pushing edge on said grate plate body (12) including a replaceable wearing part (21), said replaceable wearing part (21) being held in an operative installed position on said grate plate body (12) by said base plate (15).

2. A grate plate for a pusher grate cooler for the cooling of hot cement clinker of the type having a plurality of grate plates through which cooling air flows, said grate plates being fastened to grate plate supports alternately stationary and movable aback and forth in the grate conveying direction, said grate plate comprising:

a grate plate body (12) having upwardly open material-receiving pans (13), a base plate (15) forming a bottom wall for said material-receiving pans (13) releasably secured to the bottom of said grate plate body (12), cooling air ducts formed by said grate plate body (12) and said base plate (15), said cooling air ducts extending parallel to the longitudinal axis of said grate plate body and having lateral air discharge slots for supplying cooling air to said pans and a pushing edge on said grate plate body (12) including replaceable wearing part (21) detachably attached to said grate plate body (12) in an operative installed position, said grate plate body (12) including an upward facing surface having an overlap region (23) which is overlapped by an adjacent grate plate during operation of said pusher grate cooler, said overlap region (23) being more wear resistant than the remaining part of said upward facing surface.

3. The grate plate of claim 2 wherein said overlap region (23) has been treated by an Alonizing treatment.

4. The grate plate of claim 2 wherein said overlap region (23) has been coated with a wear resistant material.

5. A grate plate for a pusher grate cooler for the cooling of hot cement clinker of the type having a plurality of grate plates through which cooling air flows, said grate plates being fastened to grate plate supports alternately stationary and movable back and forth in the grate conveying direction, said grate plate comprising;

a grate plate body (12) having upwardly open material-receiving pans (13), cooling air ducts formed in said grate plate body (12), said cooling air ducts extending parallel to the longitudinal axis of said grate plate and having lateral air discharge slots for supplying cooling air to said pans and a pushing edge on said grate plate body (12) including a replaceable wearing part (21) detachably attached to said grate plate body (12) in an operative installed position by a tongue and groove connection with said grate plate body (12).

6. A grate plate for a pusher grate cooler for the cooling of hot cement clinker of the type having a plurality of grate plates through which cooling air flows, said grate plates being fastened to grate plate supports alternately stationary and movable back and forth in the grate conveying direction, said grate plate comprising:

a grate plate body (12) having upwardly open material-receiving pans (13), cooling air ducts formed in said grate plate body (12), said cooling air ducts extending parallel to the longitudinal axis of said grate plate and having lateral air discharge slots for supplying cooling air to said pans and a pushing edge on said grate plate body (12) including a replaceable wearing part (21) detachably attached to said grate plate body (12) in an operative installed position.

said grate plate body (12) including an upward facing surface having an overlap region (23) which is overlapped by an adjacent grate plate during operation of said pusher grate cooler, said overlap region (23) being more wear resistant than the remaining part of said upward facing surface.

7. The grate plate of claim 6 wherein said overlap region (23) has been treated by an Alonizing treatment.

8. The grate plate of claim 6 wherein said overlap region (23) has been coated with a wear resistant material.

9. A grate plate for a pusher grate cooler for the cooling of hot cement clinker of the type having a plurality of grate plates through which cooling air flows, said grate plates being fastened to grate plate supports alternately stationary and movable back and forth in the grate conveying direction, said grate plate comprising:

a grate plate body (12) having upwardly open material-receiving pans (13) and including a base plate (15) releasably secured to the bottom of said grate plate body (12) forming a bottom wall for said material receiving pans (13), cooling air ducts formed in said grate plate body (12), said cooling air ducts extending parallel to the longitudinal axis of said grate plate and having lateral air discharge slots for supplying cooling air to said pans and a pushing edge on said grate plate body (12) including a replaceable wearing part (21) detachably attached to said grate plate body (12) in an operative installed position, said replaceable wear part (21) being an integral part of said base plate (15).

* * * * *